US007117977B2

(12) United States Patent
Abe

(10) Patent No.: US 7,117,977 B2
(45) Date of Patent: Oct. 10, 2006

(54) ELEVATOR APPARATUS INCLUDING CAR WITH SUSPENDING PULLEY DEVICES ON OPPOSITE SIDES OF THE CAR

(75) Inventor: Shigeru Abe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 383 days.

(21) Appl. No.: 10/479,586

(22) PCT Filed: Jan. 29, 2003

(86) PCT No.: PCT/JP03/00846

§ 371 (c)(1),
(2), (4) Date: Dec. 4, 2003

(87) PCT Pub. No.: WO03/064309

PCT Pub. Date: Aug. 7, 2003

(65) Prior Publication Data

US 2004/0168861 A1 Sep. 2, 2004

(30) Foreign Application Priority Data

Jan. 30, 2002 (JP) ..... PCT/JP02/00722

(51) Int. Cl.
*B66B 11/08* (2006.01)

(52) U.S. Cl. ..... 187/266; 187/256; 187/262

(58) Field of Classification Search ..... 187/251, 187/254, 256, 266, 277, 250, 258, 259, 404, 187/407, 411, 264, 262
See application file for complete search history.

(56) References Cited

U.S. PATENT DOCUMENTS

| | | | | |
|---|---|---|---|---|
| 5,351,788 | A | 10/1994 | DeJong | |
| 6,247,557 | B1 | 6/2001 | Kobayashi et al. | |
| 6,290,026 | B1 | 9/2001 | Takigawa | |
| 6,345,695 | B1 * | 2/2002 | Fargo et al. | 187/277 |
| 6,598,707 | B1 * | 7/2003 | Nakagaki et al. | 187/256 |
| 2002/0000348 | A1 | 1/2002 | Faletto | |
| 2004/0035645 | A1 * | 2/2004 | Orrmann | 187/266 |

FOREIGN PATENT DOCUMENTS

| | | |
|---|---|---|
| EP | 0 866 018 | 9/1998 |
| JP | 50-138549 | 11/1975 |
| JP | 63-154578 (U) | 10/1988 |
| JP | 6-263369 | 9/1994 |
| JP | 2000-63057 | 2/2000 |
| JP | 2001-192190 | 7/2001 |
| JP | 2002-179354 | 6/2002 |
| WO | WO 99/43595 | 9/1999 |

* cited by examiner

*Primary Examiner*—Jonathan Salata
(74) *Attorney, Agent, or Firm*—Leydig, Voit & Mayer, Ltd.

(57) ABSTRACT

An elevator apparatus has first and second car suspending pulley devices mounted on a car. First and second counterweight suspending pulley devices are mounted on a counterweight. In the upper portion of the interior of a hoistway, there are arranged a car side return pulley device and a counterweight side return pulley device. A main rope suspending the car and the counterweight has first and second ends. The portion of the main rope extending from the first car suspending pulley device to the first end and the portion of the main rope extending from the second car suspending pulley device to a driving sheave are respectively arranged on opposite sides of a vertical plane passing centrally through the car.

14 Claims, 11 Drawing Sheets

ELEVATOR APPARATUS INCLUDING CAR WITH SUSPENDING PULLEY DEVICES ON OPPOSITE SIDES OF THE CAR

TECHNICAL FIELD

The present invention relates to a so-called machine-room-less elevator apparatus in which the driving machine for causing the car and the counterweight to ascend and descend is arranged not in a dedicated machine room but in the hoistway.

BACKGROUND ART

FIG. 11 is a perspective view of a conventional elevator apparatus disclosed, for example, in JP 2000-153975 A, and shows, specifically, a machine-room-less elevator adopting a 4:1 roping system.

In the drawing, a pair of car guide rails 2 and a pair of counterweight guide rails 3 are installed in a hoistway 1. A car 4 is caused to ascend and descend while being guided by the car guide rails 2. A counterweight 5 is caused to ascend and descend while being guided by the counterweight guide rails 3.

In the upper portion of the hoistway 1, there is arranged a driving machine 6 for causing the car 4 and the counterweight 5 to ascend and descend. The driving machine 6 has a driving sheave 7. Further, in the upper portion of the interior of the hoistway 1, there are arranged a car side return pulley 8 and a counterweight side return pulley 9.

Under the car 4, there are mounted a pair of first car suspending pulleys 10 and 11 and a pair of second car suspending pulleys 12 and 13. On top of the counterweight 5, there are mounted a first counterweight suspending pulley 14 and a second counterweight suspending pulley 15.

The car 4 and the counterweight 5 are suspended in the hoistway 1 by a main rope body 16 including one or more main ropes. The main rope body 16 has first and second end portions 16*a* and 16*b* connected to a fixing portion 17 in the upper portion of the hoist way 1. Further, the main rope body 16, extending from the first end portion 16*a*, is wrapped sequentially around the first car suspending pulley 10, the first car suspending pulley 11, the car side return pulley 8, the second car suspending pulley 12, the second car suspending pulley 13, the driving sheave 7, the first counterweight suspending pulley 14, the counterweight side return pulley 9, and the second counterweight suspending pulley 15 in that order, ending in the second end portion 16*b*.

In this elevator apparatus, two first car suspending pulleys 10 and 11 and two second car suspending pulleys 12 and 13 are arranged under the car 4, so that the main rope body 16 passes under the car 4 twice, whereby the force applied from the main rope body 16 to the car 4 is dispersed over a large area.

Further, the above-mentioned publication also discloses an example in which the first and second car suspending pulleys 10 through 13 are arranged on top of the car 4.

Generally speaking, in a rope type elevator apparatus, it is ideal for the upward resultant force applied from the main rope for suspending the car to the car to pass as close to the center of gravity of the car central portion as possible. Further, from the viewpoint of reducing the capacity and axial load of the driving machine, it is also important to reduce the weight of the car within a range that involves no problem in terms of the frictional force between the driving sheave and the main rope.

Further, in a machine-room-less elevator, it is also important to minimize the plan dimensions (width and depth) of the hoistway and to minimize the vertical dimensions (the height of the top portion gap of the hoistway and the pit depth).

Furthermore, when applying a gear-less-type driving machine to a low-speed elevator of large carrying capacity for passengers and baggage, an n:1 ($n \geqq 2$) roping system is adopted. As compared with the 1:1 roping system, in the n:1 roping system, the motor capacity and brake torque of the driving machine are reduced to 1/n, and it is also possible to reduce the requisite strength (number of ropes) of the main rope.

However, in the n:1 roping system, the number of sash pulleys and that of return pulleys are increased, resulting in an increase in cost and weight. In the elevator apparatus of FIG. 11, four car suspending pulleys 10 through 13 are used. Thus, the elevation apparatus involves a large number of parts and a complicated structure, with the total weight of the car 4 also being rather large.

DISCLOSURE OF THE INVENTION

The present invention has been made with a view toward solving the above-mentioned problem in the conventional technique. It is accordingly an object of the present invention to provide a machine-room-less type elevator apparatus in which it is possible to reduce the motor capacity and brake torque of the driving machine while achieving a reduction in the number of parts.

To this end, according to one aspect of the present invention, there is provided an elevator apparatus comprising: a hoistway; a driving machine having a driving sheave and arranged in the hoistway; a car caused to ascend and descend in the hoistway by the driving machine; first and second car suspending pulley devices provided on the car; a counterweight caused to ascend and descend in the hoistway by the driving machine; first and second counterweight suspending pulley devices provided on the counterweight; a car side return pulley device arranged in an upper portion of an interior of the hoistway; a counterweight side return pulley device arranged in an upper portion of the interior of the hoistway; and a main rope body for suspending the car and the counterweight, which has first and second end portions connected to a fixing portion in the hoistway and which extends from the first end portion to be sequentially wrapped around the first car suspending pulley device, the car side return pulley device, the second car suspending pulley device, the driving sheave, the first counterweight suspending pulley device, the counterweight side return pulley device, and the second counterweight suspending pulley device in that order, ending in the second end portion, wherein a portion of the main rope body extending from the first car suspending pulley device to the first end portion and a portion of the main rope body extending from the second car suspending pulley device to the driving sheave are respectively arranged on sides opposite to each other with respect to a central portion in a width direction of the car within a vertical plane of projection.

BEST MODE FOR CARRYING OUT THE INVENTION

Preferred embodiments of the present invention will now be described with reference to the drawings.

Embodiment 1

Figure 1:
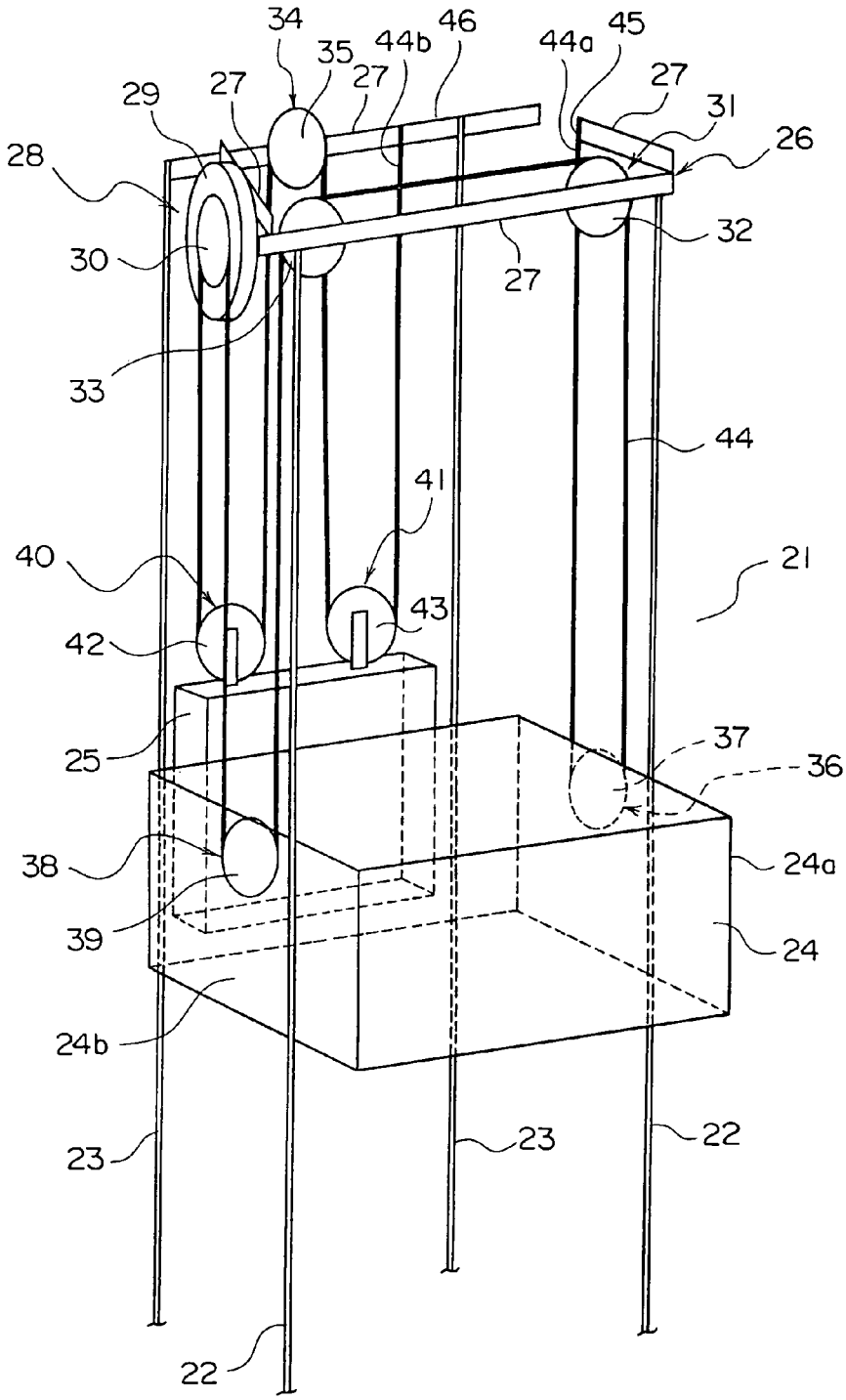
FIG. 1 is a perspective view of an elevator apparatus according to Embodiment 1 of the present invention.
Figure 2:
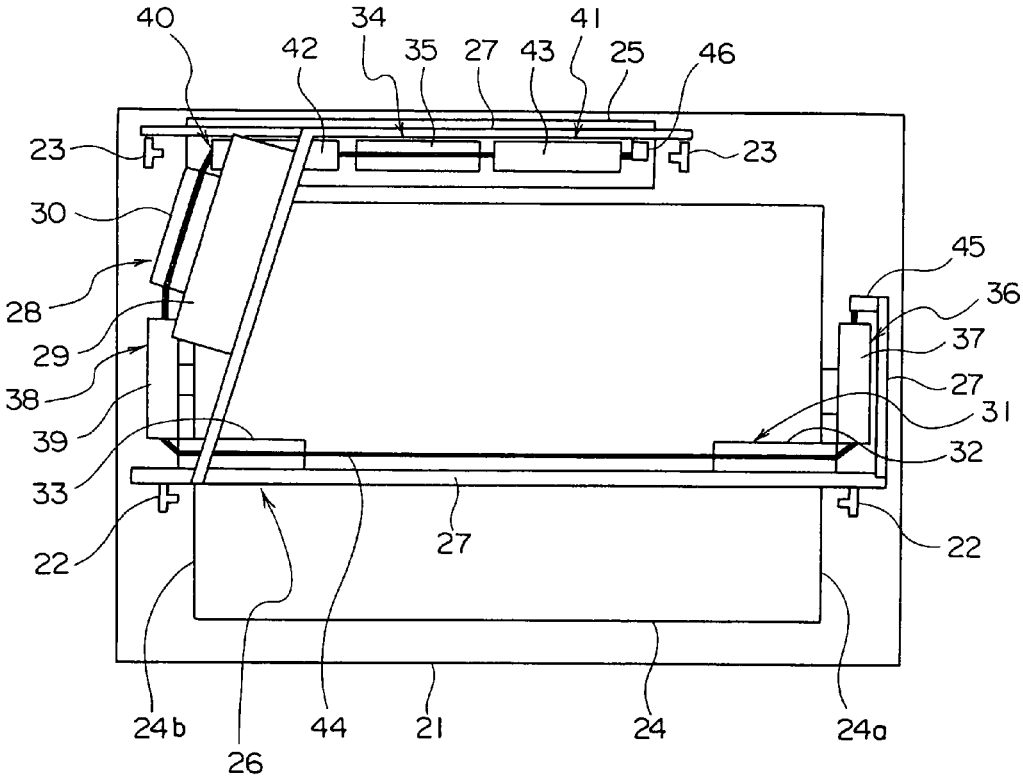
FIG. 2 is a plan view of the elevator apparatus of FIG. 1.

FIG. 1 is a perspective view of an elevator apparatus according to Embodiment 1 of the present invention, and FIG. 2 is a plan view of the elevator apparatus of FIG. 1.

In the drawings, in a hoistway 21, there are installed a pair of car guide rails 22 parallel to each other and a pair of counterweight guide rails 23 parallel to each other. A car 24 is caused to ascend and descend within the hoistway 21 while being guided by the car guide rails 22. A counterweight 25 is caused to ascend and descend within the hoistway 21 while being guided by the counterweight guide rails 23.

In the upper portion of the hoistway 21, there is arranged a machine platform 26 having a plurality of support beams (blocks) 27. The machine platform 26 is supported by the car guide rails 22 and the counterweight guide rails 23. That is, the machine platform 26 can include support beams 27 fixed solely to the car guide rails 22, support beams 27 fixed solely to the counterweight guide rails 23, and support beams 27 fixed to both the guide rails 22 and 23. Although they may be separated from each other, it is desirable for the support beams 27 to be connected together to form a firm machine platform 26.

Mounted on the machine platform 26 is a driving machine (hoist) 28 for causing the car 24 and the counterweight 25 to ascend and descend. The driving machine 28 has a motor 29 and a driving sheave 30 rotated by the motor 29. Further, the driving machine 28 has no speed reduction gear and is of a gear-less type (direct drive type) in which the driving sheave 30 is directly rotated by the motor 29.

Further, the driving machine 28 is arranged above a rear corner of the car 24 so as to overlap the car 24 in a vertical plane of projection. Further, the driving machine 28 is arranged such that, in the vertical plane of projection, the segment connecting the center of the car 24 and the driving sheave 30 extends across the motor 29. That is, in the vertical plane of projection, the motor 29 is arranged on the side closer to the center of the car 24 than the driving sheave 30.

A car side return pulley device 31 is mounted on the machine platform 26. The car side return pulley device 31 has two rotatable car side return pulleys 32 and 33. The car side return pulleys 32 and 33 are spaced apart from each other in the width direction (the horizontal direction in FIG. 2) of the car 24 such that their rotation axes extend in the depth direction (the vertical direction in FIG. 2) of the car 24. Further, the car side return pulleys 32 and 33 are arranged right above the car 24 so that they may overlap the car 24 in a vertical plane of projection.

A counterweight side return pulley device 34 is mounted on the machine platform 26. The counterweight side return pulley device 34 has one rotatable counterweight side return pulley 35. The counterweight side return pulley 35 is arranged right above the counterweight 25 such that its rotation axis extends in the depth direction of the car 24.

The car 24 has first and second side walls 24*a* and 24*b* opposed to the car guide rails 22. A first car suspending pulley device 36 is mounted on a first mounting member (not shown) fixed to the car frame (not shown) of the car 24. The first car suspending pulley device 36 has a rotatable, first car suspending pulley 37 arranged parallel to the first sidewall 24*a*. The first car suspending pulley 37 is opposed to the first side wall 24*a*. That is, the rotation axis of the first car suspending pulley 37 extends in a direction perpendicular to the first side wall 24*a*.

A second car suspending pulley device 38 is mounted on a second mounting member fixed to the car frame (not shown) of the car 24. The second car suspending pulley device 38 has one rotatable second car suspending pulley 39 arranged parallel to the second side wall 24*b*. The second car suspending pulley 39 is opposed to the second sidewall 24*b*. That is, the rotation axis of the second car suspending pulley 39 extends in a direction perpendicular to the second side wall 24*b*.

The first and second car suspending pulleys 31 and 39 are arranged symmetrically on both sides of the car 24, with the car 24 being therebetween.

First and second counterweight suspending pulley devices 40 and 41 are mounted on top of the counterweight 25. The first counterweight suspending pulley device 40 has a rotatable, first counterweight suspending pulley 42. The second counterweight suspending pulley device 41 has a rotatable, second counterweight suspending pulley 43.

The first and second counterweight suspending pulleys 42 and 43 are spaced apart from each other in the width direction of the counterweight 25 (the horizontal direction in FIG. 2) such that their rotation axes extend in the thickness direction of the counterweight 25 (the vertical direction in FIG. 2).

The car 24 and the counterweight 25 are suspended in the hoistway 21 by a main rope body 44 including one or a plurality of (usually three or more) main ropes. The main rope body 44 has first and second end portions 44*a* and 44*b*. The first and second end portions 44*a* and 44*b* are connected to the fixing portion in the upper portion of the hoistway 21, that is, the machine platform 26, through the intermediation of rope end fixing devices 45 and 46. Instead of being connected to the machine platform 26, the first and second end portions 44*a* and 44*b* may, for example, be connected to the guide rails 22 and 23.

The main rope body 44, extending from the first end portion 44*a*, is sequentially wrapped around the first car suspending pulley 37, the car side return pulley 32, the car side return pulley 33, the second car suspending pulley 39, the driving sheave 30, the first counterweight suspending pulley 42, the counterweight side return pulley 35, and the second counterweight suspending pulley 43 in that order, ending in the second end portion 44*b*. That is, the car 24 and the counterweight 25 are suspended by a 4:1 roping system.

Each of the first car suspending pulley 37, the car side return pulley 32, the car side return pulley 33, the second car suspending pulley 39, the driving sheave 30, the first counterweight suspending pulley 42, the counterweight side return pulley 35, and the second counterweight suspending pulley 43, is equipped with a groove into which the main rope body 44 is inserted.

Further, the portion of the main rope body 44 extending from the first car suspending pulley device 36 to the first end portion 44*a* and the portion of the main rope body 44 extending from the second car suspending pulley device 38 to the driving sheave 30 are arranged on the sides opposite to each other in the vertical plane of projection with respect to the central portion in the width direction of the car 24.

Further, in this elevator apparatus, the plane formed by the two car guide rails 22 and the plane formed by the two counterweight guide rails 23 are parallel to each other. Thus, the counterweight 25 is arranged behind the car 24. This arrangement of the counterweight 25 is called a "weight-falling-behind system", which is suitable for a case in which a wide car 24 is used and which can suppress an increase in the width of the hoistway 21.

By adopting the above layout in a machine-room-less type elevator using the 4:1 roping system, it is possible for the number of the car suspending pulleys 37, 39 used in each of the first and second car suspending pulley devices 36 and 38 to be one, thus reducing the number of parts and achieving simplification in structure.

Further, since the total number of the car suspending pulleys 37, 39 mounted on the car 24 can be a minimum number of two, it is possible to reduce the total weight of the car 24.

Further, in the 4:1 roping system, the car 24 and the counterweight 25 are raised and lowered in opposite directions at the same speed. And, the speed of the main rope body 44 passing the driving sheave 30 is four times the speed of the car 24. As a result, as compared with the 1:1 roping system, while the rotating speed of the driving sheave 30 is four times that of the 1:1 roping system, the driving torque and the brake torque required of the driving machine is ¼ of that of the 1:1 roping system. Thus, the capacity of the driving machine 28 may be ¼ of that of the 1:1 roping system, thus making it possible to use a relatively inexpensive driving machine 28.

Generally speaking, in a machine-room-less elevator, the noise of the driving machine 28 is easily transmitted to the interior of the car 24, so that it is desirable to use a low-noise, gear-less type driving machine 28. However, as compared with a geared type one, a gear-less type driving machine is rather expensive. In this regard, in Embodiment 1, it is possible to reduce the capacity of the driving machine 28 to ¼, so that it is possible to effectively reduce cost and use a low-noise gear-less type driving machine 28 at relatively low cost. However, as far as a low-noise geared type driving machine can be realized, the driving machine is not restricted to a gear-less one.

Further, since the driving machine 28 is arranged above the car 24 so as to overlap the car 24 in a vertical plane of projection, it is possible to reduce the area of the hoistway 21.

Further, since the driving machine 28 is arranged such that, in a vertical plane of projection, the segment connecting the center of the car 24 and the driving sheave 30 extends across the motor 29, it is possible for the worker on the car 24 to easily perform maintenance operation on the brake device (not shown) of the driving machine 28, etc.

Note that the orientation of the driving machine 28 is not restricted to that of Embodiment 1. That is, as long as no problem is involved in terms of maintenance operability, it is possible to arrange the driving sheave 30 on the side nearer to the car 24 and arrange the motor 29 on the outer side.

Furthermore, since the first and second car suspending pulleys 37 and 39 are arranged parallel to the first and second side walls 24*a* and 24*b* of the car 24, it is possible to minimize the dimension in the width direction (the horizontal direction in FIG. 2) of the hoistway 21.

Further, since the first and second car suspending pulleys 37 and 39 are opposed to the first and second side walls 24*a* and 24*b* of the car 24, it is possible to reduce the vertical dimension of the hoistway 21.

The car side return pulleys 32 and 33 and the counterweight side return pulley 35 can be arranged by utilizing the vertical installation space for the driving machine 28, so that there is no need to increase the vertical dimension of the hoistway 21 due to the return pulleys 32, 33, and 35.

Further, since the machine platform 26 is supported by the guide rails 22 and 23, and the load on the guide rails 22 and 23 is supported by the bottom portion of the hoistway 21, it is possible to reduce the burden of the load on the building side, for example, the wall portion of the hoistway 21.

However, it is also possible to fix the machine platform 26 to the building so as to apply the load of the machine platform 26 entirely or partially on the portion of the building at the top of the hoistway 21. In this case, the strength required of the building is rather high, whereas the burden on the guide rails 22 and 23 is reduced, making it possible to reduce the size of the guide rails 22 and 23.

Further, since the first and second counterweight suspending pulleys 42 and 43 are arranged so as to be aligned in a straight line in the width direction of the counterweight 25, it is possible to reduce the thickness of the counterweight 25 and to reduce the depth dimension of the hoistway 21.

Note that, by arranging the car suspending pulleys 37 and 39 on top of or on a side of the car 24, it is possible to reduce the pit depth of the hoistway 21.

Embodiment 2

Figure 3:
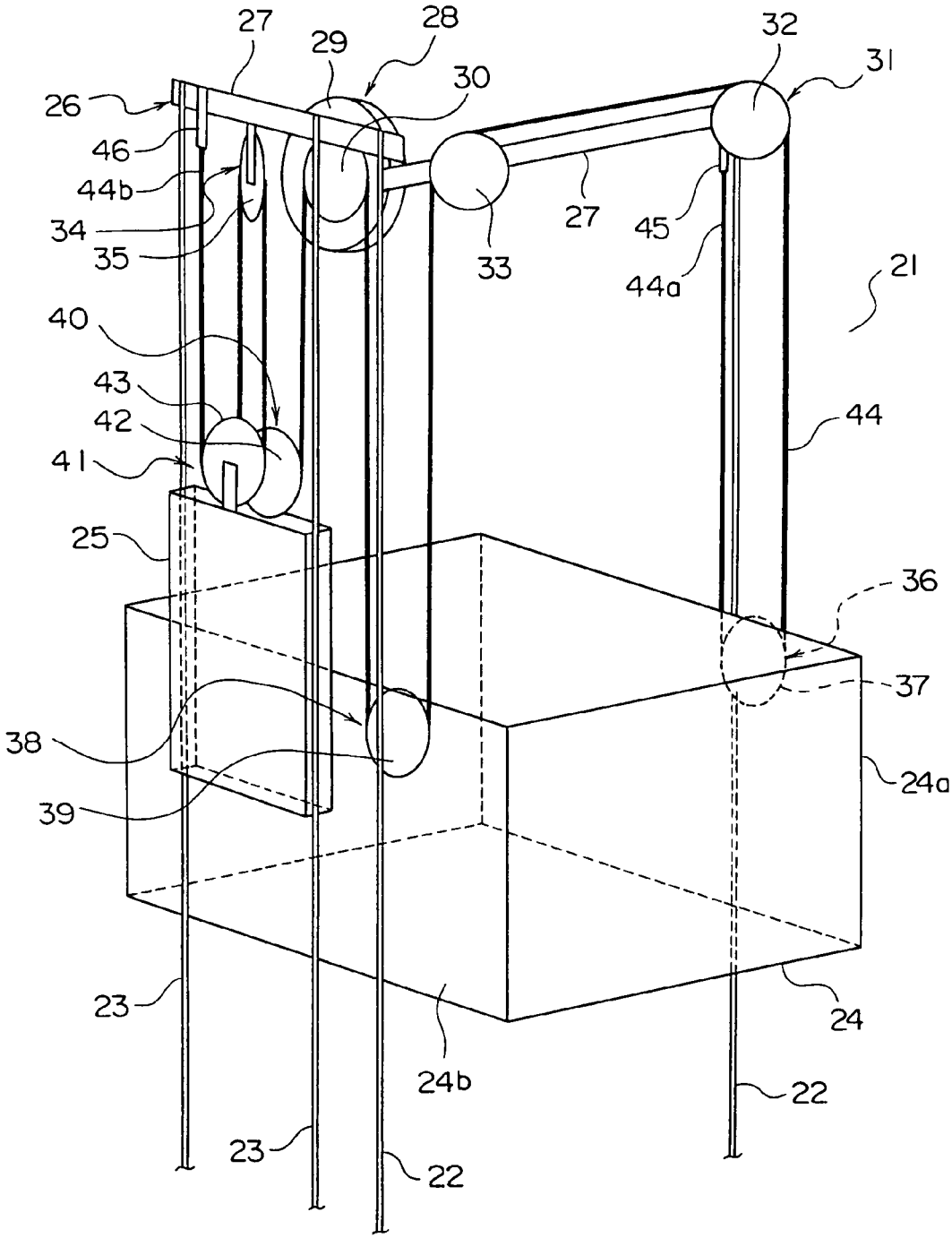
FIG. 3 is a perspective view of an elevator apparatus according to Embodiment 2 of the present invention.
Figure 4:
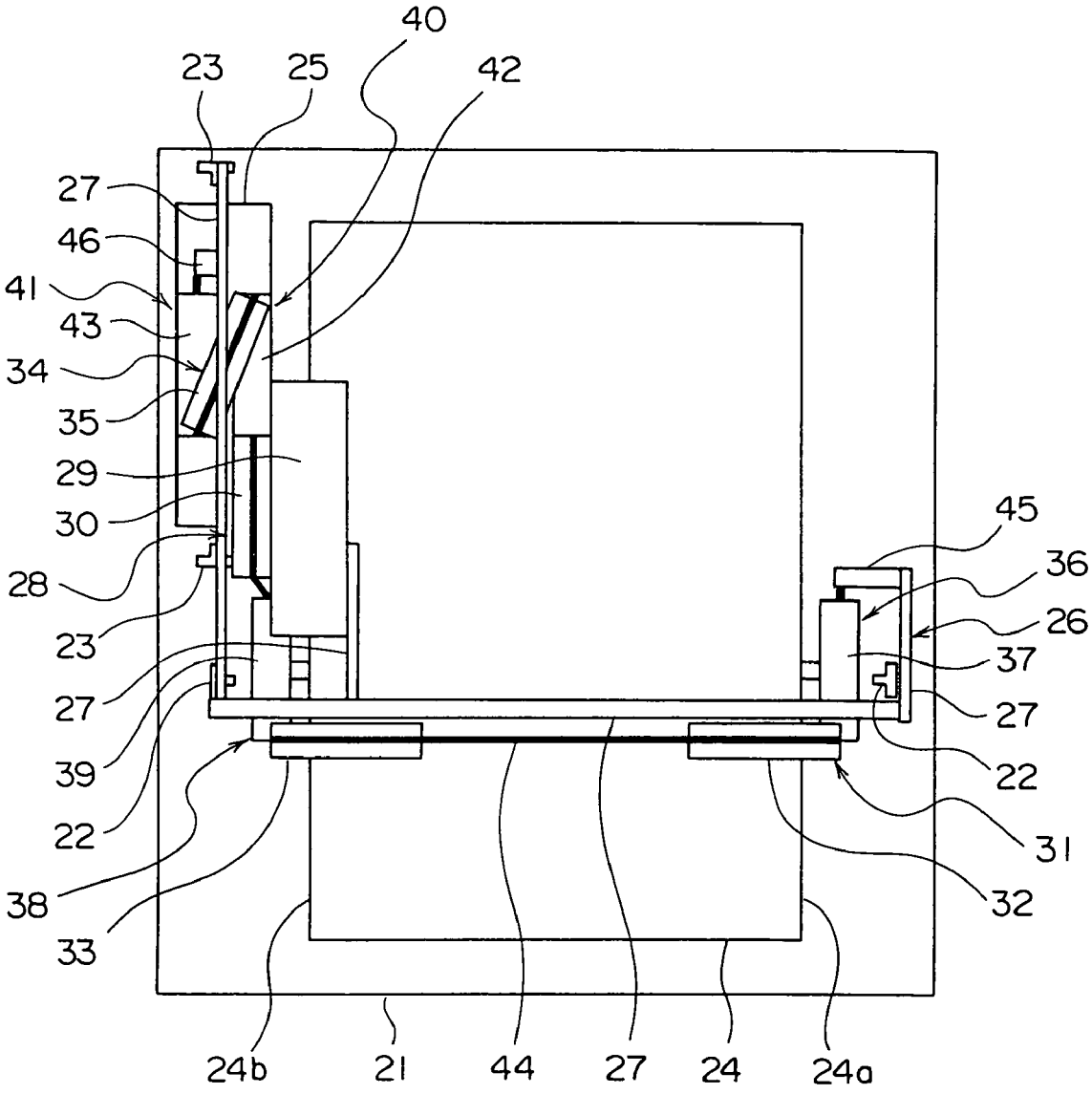
FIG. 4 is a plan view of the elevator apparatus of FIG. 3.

Next, FIG. 3 is a perspective view of an elevator apparatus according to Embodiment 2 of the present invention, and FIG. 4 is a plan view of the elevator apparatus of FIG. 3.

In this example, the plane formed by the two car guide rails 22 and the plane formed by the two counterweight guide rails 23 are perpendicular to each other. Thus, the counterweight 25 is arranged by the side of the car 24. This arrangement of the counterweight 25 is called a "weight-falling-sidewise" system, which is suitable for the car 24 with a large depth dimension and which allows the car 24 to be arranged over the entire depth dimension of the hoistway 21, thus making it possible to minimize the dimension in the depth direction of the hoistway 21. Further, it is also possible to provide doorways on both the front and rear sides of the car 24.

Further, due to the adoption of the "weight-falling-sidewise" system, the driving sheave 30 and the first and second counterweight suspending pulleys 42 and 43 are arranged such that their rotation axes extend obliquely with respect to the width direction of the car 24. Further, the counterweight side return pulley 35 is arranged such that its rotation axis extends obliquely with respect to the width direction of the car 24.

Furthermore, the first and second counterweight suspending pulleys 42 and 43 are arranged so as to be aligned in the same axis. That is, the first and second counterweight suspending pulleys 42 and 43 are arranged so as to be in an overlapping relationship in the thickness direction of the counterweight 25 (the horizontal direction FIG. 4), whereby it is possible to diminish the dimension in the width direction (the vertical direction in FIG. 4) of the counterweight 25.

In this way, the present invention is also applicable to an elevator apparatus of the "weight-falling-sidewise" system, making it possible to realize a machine-room-less elevator of the 4:1 roping system with the size of the driving machine 28 reduced, while reducing the number of parts.

Embodiment 3

Figure 5:
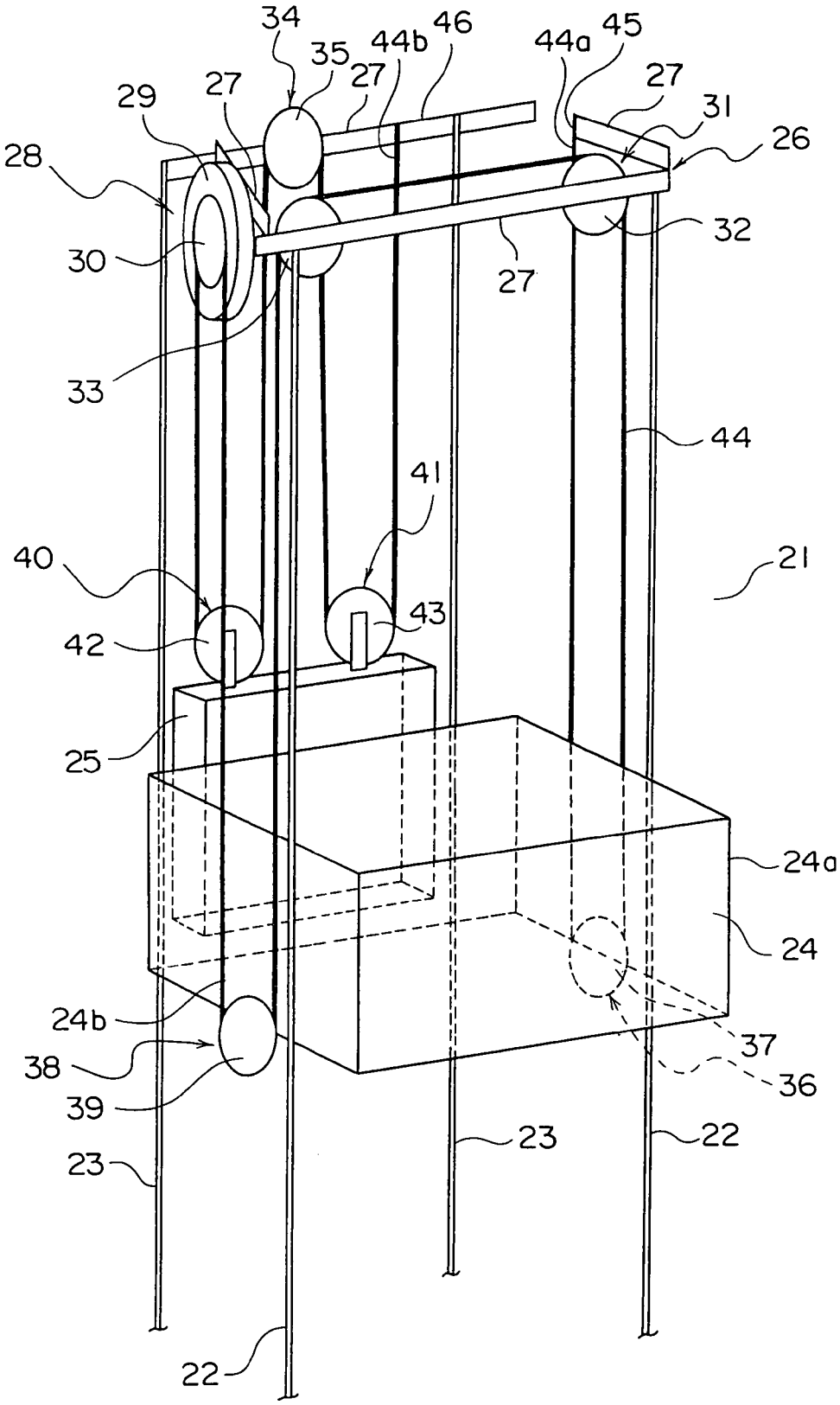
FIG. 5 is a perspective view of an elevator apparatus according to Embodiment 3 of the present invention.
Figure 6:
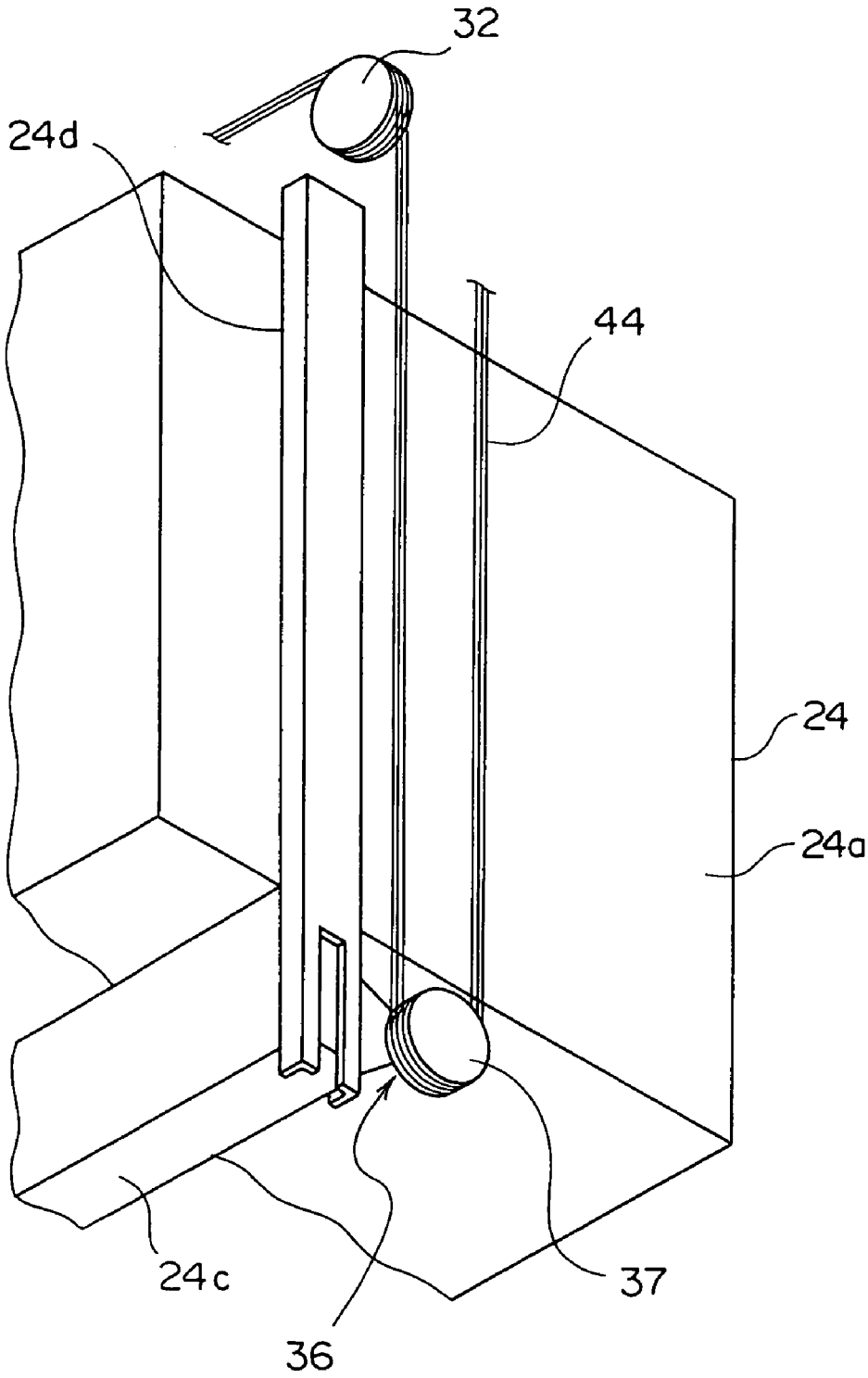
FIG. 6 is a perspective view showing a main portion of FIG. 5.

Next, FIG. 5 is a perspective view of an elevator apparatus according to Embodiment 3 of the present invention, and FIG. 6 is a perspective view showing a main portion of FIG. 5. FIG. 6 is a perspective view partially showing the right-hand side surface, the bottom surface, and the top surface of the car 24.

In this example, the car suspending pulleys 37 and 39 are arranged below the car 24. Further, the car suspending pulleys 37 and 39 are arranged between the first and second side walls 24*a* and 24*b* and the hoistway walls in a vertical plane of projection. Further, the rotation axes of the car suspending pulleys 37 and 39 extend in a direction perpendicular to the first and second side walls 24*a* and 24*b*.

That is, in Embodiment 3, the positions of the car suspending pulleys 37 and 39 of Embodiment 1 are shifted downwards. Further, the car suspending pulleys 37 and 39 are mounted to the lower beam (the lower horizontal portion) 24*c* of the car frame 24*c*. Otherwise, this embodiment is of the same construction as Embodiment 1.

In this elevator apparatus, in which the car suspending pulleys 37 and 39 are arranged below the car 24, the bearing portions of the car suspending pulleys 37 and 39 can be arranged below the car 24, making it possible to prevent an increase in the width dimension of the hoistway 21.

Further, in this elevator apparatus, in which the direction of the rotation axes of the car suspending pulleys 37 and 39 and the direction of the rotation axes of the car side return pulleys 32 and 33 are perpendicular to each other, when the car 24 moves to the upper portion of the interior of the hoistway 21, twist is generated in the ropes of the main rope body 44. In this regard, in Embodiment 3, in which the car suspending pulleys 37 and 39 are arranged below the car 24, when the car 24 moves to the upper portion of the interior of the hoistway 21, it is possible to secure a sufficient distance between the car suspending pulleys 37 and 39 and the car side return pulleys 32 and 33, making it possible to restrain generation of twist in the ropes of the main rope body 44 and to prevent wear of the main rope body 44.

Further, since the first and second car suspending pulleys 37 and 39 are mounted to the lower beam 24*c* of the car frame 24*c*, it is possible to secure a sufficient mounting strength for the first and second car suspending pulleys 37 and 39, and to provide a structure easy of mounting.

Furthermore, since the first and second car suspending pulleys 37 and 39 are mounted to the lower beam 24*c* of the car frame, it is possible to reduce the strength of the vertical frame 24*d* as compared with the case in which they are mounted to the vertical frame 24*d* of the car frame, thereby making it possible to reduce the weight of the car frame.

Embodiment 4

Figure 7:
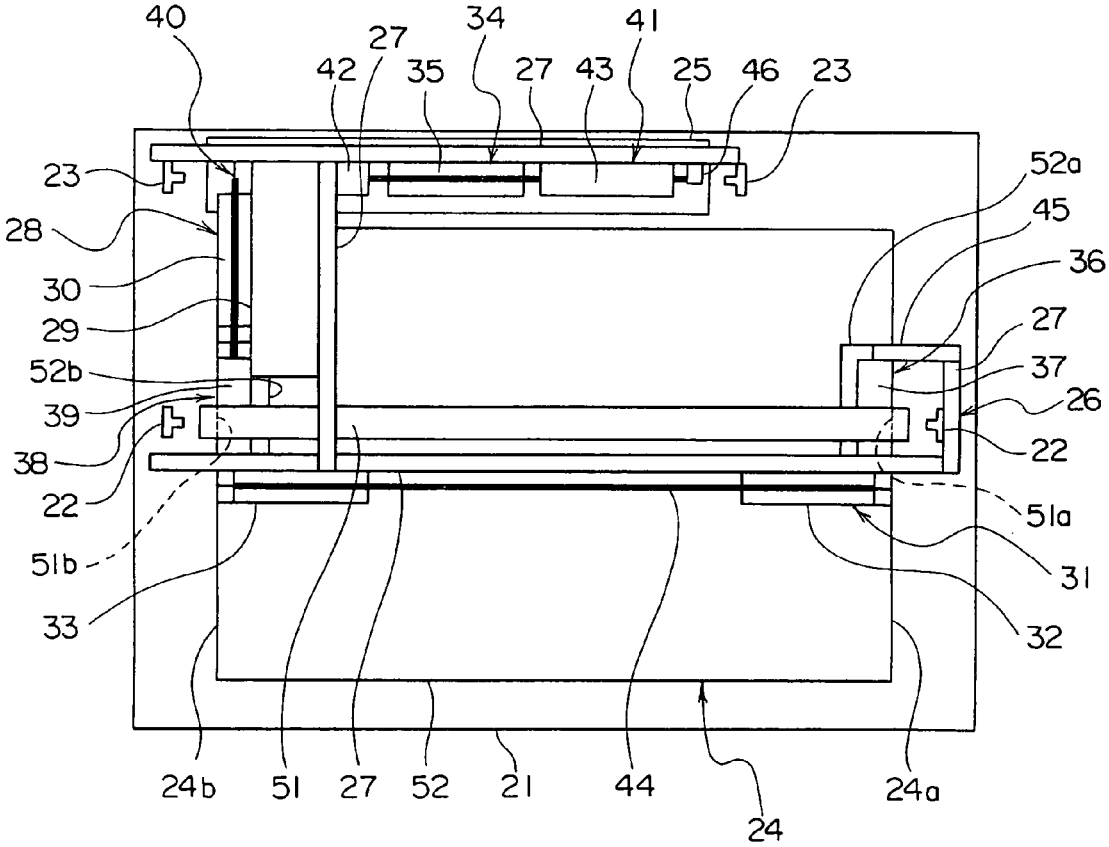
FIG. 7 is a plan view of an elevator apparatus according to Embodiment 4 of the present invention.
Figure 8:
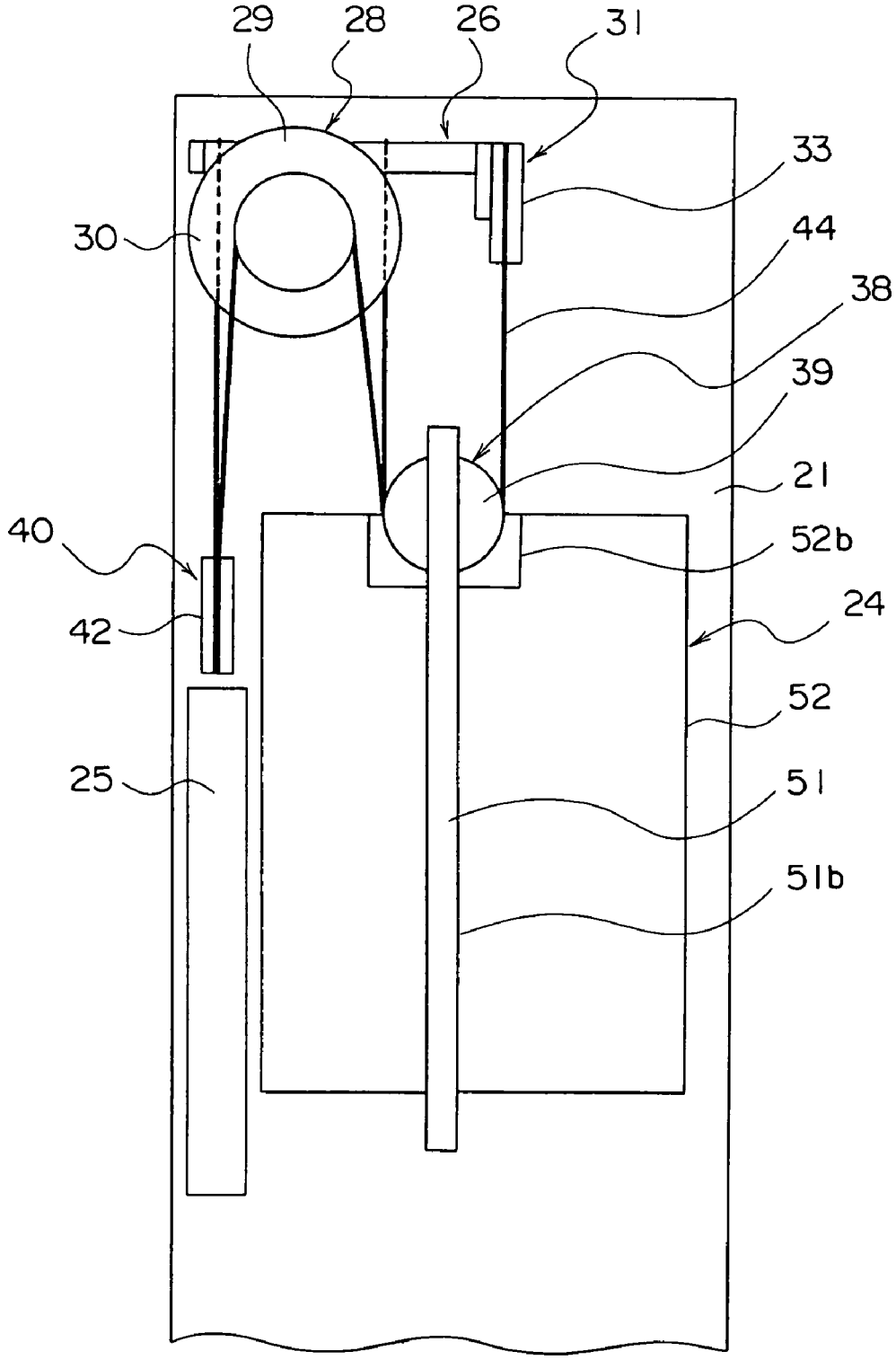
FIG. 8 is a side view of the elevator apparatus of FIG. 7.

Next, FIG. 7 is a plan view of an elevator apparatus according to Embodiment 4 of the present invention, and FIG. 8 is a side view of the elevator apparatus of FIG. 7. In FIG. 8, the guide rails 22 and 23 are omitted.

In the drawings, although not described with reference to Embodiments 1 and 2, the car 24 has a car frame 51 and a cage 52 supported by the car frame 51. The car frame 51 includes first and second vertical frames 51*a* and 51*b* extending vertically so as to be parallel to each other and opposed to the guide rails 22.

First and second recesses 52*a* and 52*b* are provided at the upper ends of the first and second side walls 24*a* and 24*b*, respectively. The first car suspending pulley 37 is mounted on the first vertical frame 51*a* and arranged in the first recess 52*a*. The second sash pulley 39 is mounted on the second vertical frame 51*b* and arranged in the second recess 52*b*.

Further, the two portions of the main rope body 44 extending upwardly from the first car suspending pulley 37 are arranged so as to be distributed respectively on either side of the plane formed by the pair of guide rails 22. Similarly, the two portions of the main rope body 44 extending upwardly from the second car suspending pulley 39 are arranged so as to be distributed respectively on either side of the plane formed by the pair of guide rails 22.

In this elevator apparatus, in which the first and second car suspending pulleys 37 and 39 are accommodated in the first and second recesses 52*a* and 52*b*, it is possible to diminish the dimension in the width direction of the hoistway 21. Usually, on top of the cage 52, there is a space for accommodating an illuminating device, etc., so that, by utilizing a part of this space, it is possible to provide the recesses 52*a* and 52*b*, without having to diminish the space inside the cage 52.

Further, due to the provision of the recesses 52*a* and 52*b*, it is possible to mount the car suspending pulleys 37 and 39 on the vertical frames 51*a* and 51*b*, and it is possible to arrange the portions of the main rope body 44 extending upwardly from the car suspending pulleys 37 and 39 so as to distribute them uniformly on either side of the plane formed by the car frame 51. Thus, by arranging the car frame 51 such that it passes near the center of gravity of the car 24, it is possible to arrange the main rope body 44 in a well-balanced manner with respect to the center of gravity of the car 24, enabling the upward resultant force applied to the car 24 to pass near the center of gravity of the car 24.

Due to this arrangement, no offset load is applied to the guide shoe and the guide roller (none of which is shown), and no steady stress is easily generated. Further, since it is possible to arrange the car frame 51 such that it passes near the center of gravity of the car 24, it is possible to realize a car structure in which no excessive force is easily applied to the car frame 51 even at the time of emergency stop.

In Embodiments 1 and 2 also, it is possible to reduce the offset load applied to the guide shoe and the guide roller during normal operation by arranging the car suspending pulleys 37 and 39 such that the car 24 is suspended at its center of gravity. In this case, however, the car frame does not pass the center of gravity of the car frame 24, so that it is necessary to extend the mounting member from the car frame to support the car suspending pulleys 37 and 39.

Embodiment 5

Figure 9:
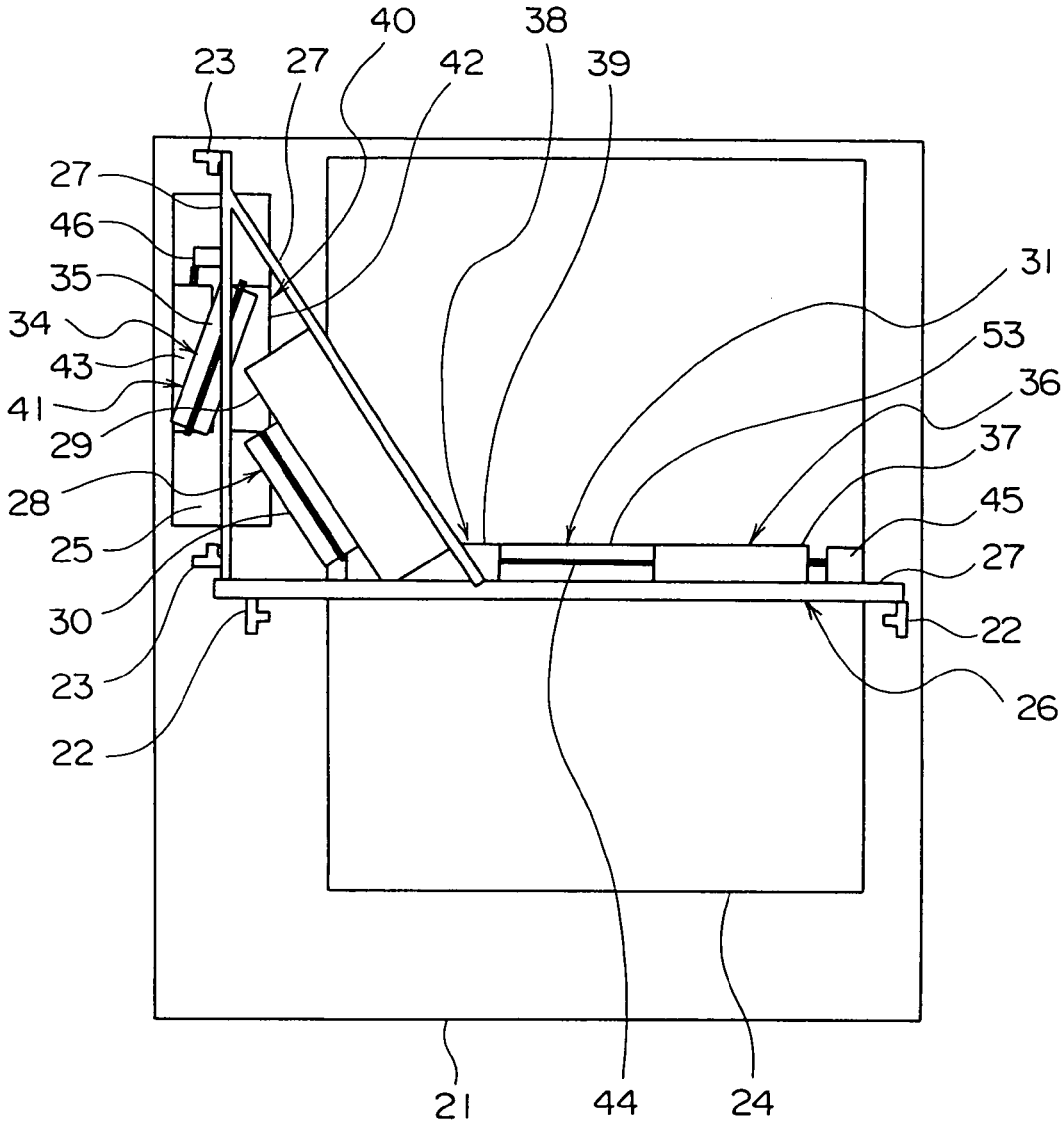
FIG. 9 is a plan view of an elevator apparatus according to Embodiment 5 of the present invention.
Figure 10:
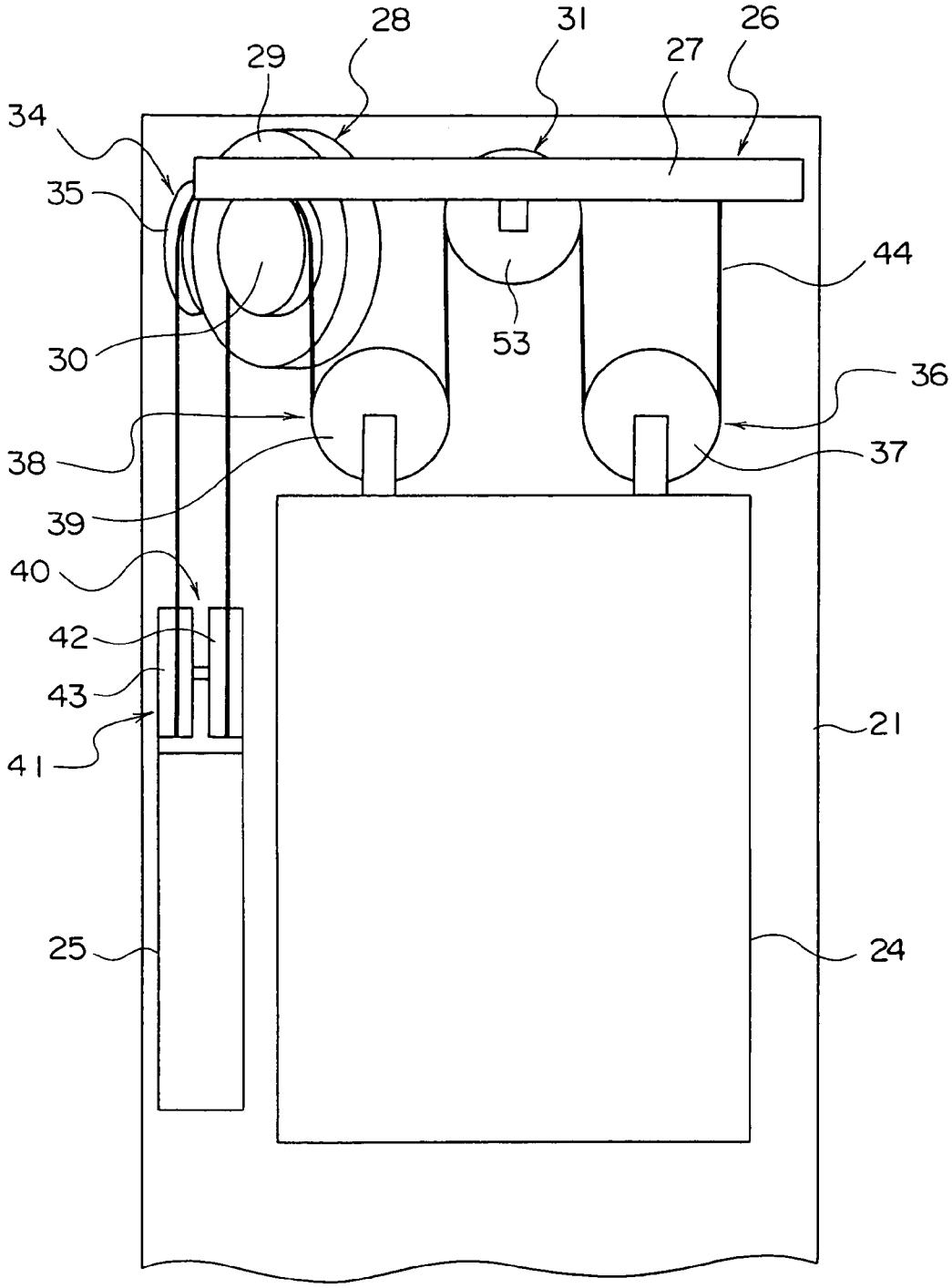
FIG. 10 is a front view of the elevator apparatus of FIG. 9.
Figure 11:
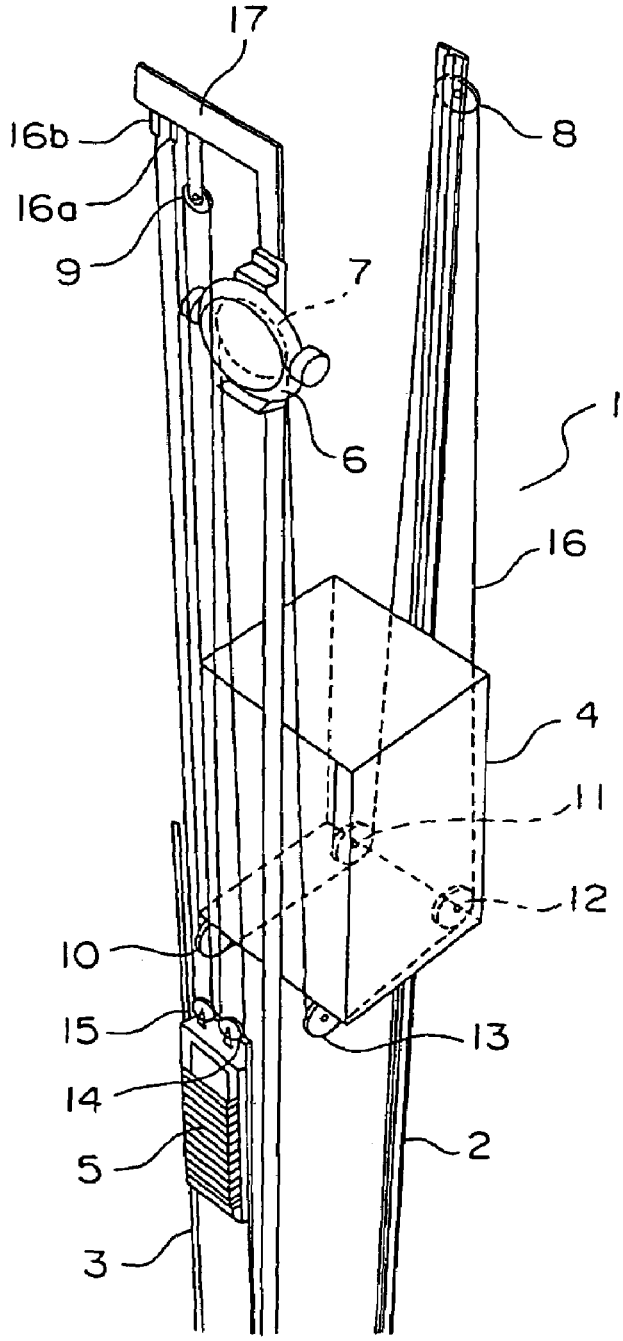
FIG.11 (PRIOR ART)
FIG. 11 is a perspective view of an example of a conventional elevator apparatus.

Next, FIG. 9 is a plan view of an elevator apparatus according to Embodiment 5 of the present invention, and FIG. 10 is a front view of the elevator apparatus of FIG. 9. In FIG. 10, the guide rails 22 and 23 are omitted.

In the drawings, the first and second car suspending pulleys 37 and 39 are arranged on top of the car 24 so as to be situated inside the area of the car 24 in a vertical plane of projection. Further, the first and second car suspending pulleys 37 and 39 are arranged such that their rotation axes extend in the depth direction of the car 24.

The car side return pulley device 31 has only one car side return pulley 53. The car side return pulley 53 is mounted on the machine platform 26 above the car 24. Further, the car side return pulley 53 is arranged such that its rotation axis extends in the depth direction of the car 24.

In this elevator apparatus, the height dimension of the requisite gap at the top of the hoistway 21 is larger than that in Embodiment 2. However, since only one car side return pulley 53 suffices, it is possible to further reduce the number of parts, achieving a further simplification in structure. The total number of pulleys can be reduced to a minimum of seven.

The main ropes included in the main rope body 44 may consist of steel ropes. By using ropes exhibiting a large coefficient of friction and superior in flexibility, it is possible to diminish the diameters of the driving sheave 30 and the other pulleys, thereby making it possible to diminish the installation space for them. As a result, it is possible to utilize the space in the hoistway 21 more efficiently, minimizing the height dimension of the hoistway 21.

Further, to prevent the noise generated in the driving sheave and the other pulleys from being transmitted to the interior of the cage, the driving sheave, the car side return pulleys, the counterweight side return pulleys, the car suspending pulleys, and the counterweight suspending pulleys may be covered, at least partially, with a soundproof cover.

Further, while it is desirable for the number of return pulleys used in the car side return pulley device and the counterweight side return pulley device and the number of sash pulleys used in the car suspending pulley device and the counterweight suspending pulley device to be minimum, it is also possible to provide additional pulleys as needed.

The Invention claimed is:

1. An elevator apparatus comprising:

a hoistway;

a driving machine having a driving sheave and arranged in the hoistway;

a car caused to ascend and descend in the hoistway by the driving machine;

first and second car suspending pulley devices provided on the car;

a counterweight caused to ascend and descend in the hoistway by the driving machine;

first and second counterweight suspending pulley devices provided on the counterweight;

a car side return pulley device arranged in an upper portion of an interior of the hoistway;

a counterweight side return pulley device arranged in an upper portion of the interior of the hoistway; and a main rope body for suspending the car and the counterweight, which has first and second end portions connected to a fixing portion in the hoistway and which extends from the first end portion to be sequentially wrapped around the first car suspending pulley device, the car side return pulley device, the second car suspending pulley device, the driving sheave, the first counterweight suspending pulley device, the counterweight side return pulley device, and the second counterweight suspending pulley device in that order, ending in the second end portion, wherein a portion of the main rope body extending from the first car suspending pulley device to the first end portion and a portion of the main rope body extending from the second car suspending pulley device to the driving sheave are respectively arranged on sides opposite to each other with respect to a central portion in a width direction of the car within a vertical plane of projection.

2. An elevator apparatus according to claim 1, wherein the car side return pulley device is arranged right above the car so as to overlap the car within the vertical plane of projection.

3. An elevator apparatus according to claim 1, wherein the driving machine is a gearless type driving machine in which the driving sheave is rotated directly by a motor.

4. An elevator apparatus according to claim 1, wherein the driving machine is arranged in an upper portion of the interior of the hoistway.

5. An elevator apparatus according to claim 4, wherein the driving machine is arranged so as to overlap the car within the vertical plane of projection.

6. An elevator apparatus according to claim 4, wherein the driving machine further includes a motor for rotating the driving sheave, and is arranged such that, in the vertical plane of projection, a segment connecting a center of the car and the driving sheave extends across the motor.

7. An elevator apparatus according to claim 1, further comprising a pair of guide rails arranged in the hoistway for guiding the car as the car ascends and descends, wherein the car has first and second side walls, and wherein the first car suspending pulley device has a first car suspending pulley arranged parallel to the first side wall and the second car suspending pulley device has a second car suspending pulley arranged parallel to the second side wall.

8. An elevator apparatus according to claim 1, further comprising a pair of guide rails arranged in the hoistway for guiding the car as the car ascends and descends, wherein the car has first and second side walls, and wherein the first car suspending pulley device has a first car suspending pulley arranged so as to be opposed to the first side wall and the second car suspending pulley device has a second car suspending pulley arranged so as to be opposed to the second side wall.

9. An elevator apparatus according to claim 1, wherein the first and second car suspending pulley devices are arranged below the car.

10. An elevator apparatus according to claim 1, further comprising a pair of guide rails arranged in the hoistway for guiding the car as the car ascends and descends, wherein the car has first and second side walls opposed to the car guide rails, the first and second side walls having first and second recesses provided at their upper ends, respectively, and wherein the first car suspending pulley device has a first car suspending pulley arranged in the first recess and the second car suspending pulley device has a second car suspending pulley arranged in the second recess.

11. An elevator apparatus according to claim 10, wherein the car has a car frame including first and second vertical frames opposed to the car guide rails, the first car suspending pulley is mounted on the first vertical frame, the second car suspending pulley is mounted on the second vertical frame, portions of the main rope body extending upwardly from the first car suspending pulley are respectively arranged on either side of a plane formed by the pair of car guide rails, and portions of the main rope body extending upwardly from the second car suspending pulley are respectively arranged on either side of the plane formed by the pair of car guide rails.

12. An elevator apparatus according to claim 1, wherein the first and second car suspending pulley devices are arranged on top of the car and are arranged inside an area of the car in the vertical plane of projection.

13. An elevator apparatus according to claim 12, wherein the car side return pulley device has only one car side return pulley.

14. An elevator apparatus according to claim 1, wherein the first counterweight suspending pulley device has a first counterweight suspending pulley and the second counterweight suspending pulley device has a second counterweight suspending pulley, the first and second counterweight suspending pulleys being aligned in the same axis.

* * * * *